United States Patent [19]

Gladd et al.

[11] 4,448,477

[45] May 15, 1984

[54] ELECTRIC SOCKET TERMINAL

[75] Inventors: Joseph H. Gladd, Cortland; Robert G. Plyler, Vienna; Lyle B. Suverison, Fowler, all of Ohio

[73] Assignee: General Motors Corporation, Detroit, Mich.

[21] Appl. No.: 359,686

[22] Filed: Mar. 19, 1982

[51] Int. Cl.[3] ..... H01R 11/22

[52] U.S. Cl. ..... 339/258 RR; 339/217 S; 339/256 R

[58] Field of Search ..... 339/217 R, 217 S, 256 R, 339/256 S, 258 R, 258 RR, 276 SF, 58 R

[56] References Cited

U.S. PATENT DOCUMENTS

| | | | |
|---|---|---|---|
| 2,711,524 | 6/1955 | Beaver | 339/256 |
| 3,404,367 | 10/1968 | Henschen | 339/217 |
| 3,425,030 | 1/1969 | Hadden | 339/256 |
| 3,539,965 | 11/1970 | Morehart et al. | 339/17 |
| 3,673,551 | 6/1972 | McDonough | 339/258 R |
| 4,032,215 | 6/1977 | Jarmofsky et al. | 339/258 R |
| 4,385,794 | 5/1983 | Lucius | 339/276 SF X |

FOREIGN PATENT DOCUMENTS

| | | |
|---|---|---|
| 1258678 | 3/1961 | France . |
| 528158 | 9/1972 | Switzerland . |
| 1517601 | 7/1980 | United Kingdom . |

*Primary Examiner*—Eugene F. Desmond
*Assistant Examiner*—Steven C. Bishop
*Attorney, Agent, or Firm*—F. J. Fodale

[57] ABSTRACT

An electric socket terminal has an elongated, resilient socket comprising two axially spaced split tubes joined by a circumferential array of juxtaposed spring strips and means for retaining the electric socket terminal in a cavity of an insulator block. The retaining means is beside the elongated, resilient socket and includes a U-shaped guard and a resilient latch tang. The U-shaped guard has axially spaced legs which are integrally attached to the respective split tubes and the resilient latch tang is integrally attached at one end to one of the legs of the U-shaped guard and extends generally axially of the elongated, resilient socket.

3 Claims, 4 Drawing Figures

ELECTRIC SOCKET TERMINAL

This invention relates generally to electric socket terminals and, more particularly, to electric socket terminals which have an elongated, resilient socket comprising a pair of split tubes joined by a circumferential array of juxtaposed spring strips and means for retaining the terminal in a cavity of an insulator block or the like.

U.S. Pat. No. 3,404,367 granted to Homer Ernst Henschen on Oct. 1, 1968 discloses an electric terminal 2 which has an elongated, resilient socket of the general type in question and means for retaining the terminal 2 in a cavity 30 of an insulator block 26. The retaining means of the terminal takes the more or less common form of an ear or ears 12 which engage a cavity shoulder 36 to stop terminal insertion and a resilient latch tang 22 which deflects over and engages another cavity shoulder 38 to prevent terminal withdrawal. A drawback of the Henschen arrangement is that the latch tang 22 is struck and bent from a web behind the socket. This arrangement increases the length of the terminal while at the same time practically restricts the resilient latch tang to a short length thereby introducing the risk of the resilient latch tang being overstressed during terminal insertion.

The object of this invention is to provide an electric socket terminal of the above noted type which has improved retention means particularly with regards to the arrangement of the resilient latch tang.

One feature of the invention is that the resilient latch tang is beside the elongated, resilient socket so that the length of the terminal need not be increased to accommodate the resilient Another feature of the invention is that the location of the resilient latch tang beside the elongated, resilient socket permits substantial freedom in choosing the length of the resilient latch tang so that the risk of overstressing the resilient latch tang during terminal insertion is avoided.

Yet another feature of the invention is that the resilient latch tang is struck and bent from a web of the terminal which is beside the elongated, resilient socket leaving a U-shaped guard which protects the resilient latch tang during handling and assembly.

Still yet another feature of the invention is that the resilient latch tang is bent so that it overlies the elongated, resilient socket for increased protection.

Other objects and features of the invention will become apparent to those skilled in the art as the disclosure is made in the following detailed description of a preferred embodiment of the invention as illustrated in the accompanying sheets of drawing in which.

Figure 1:
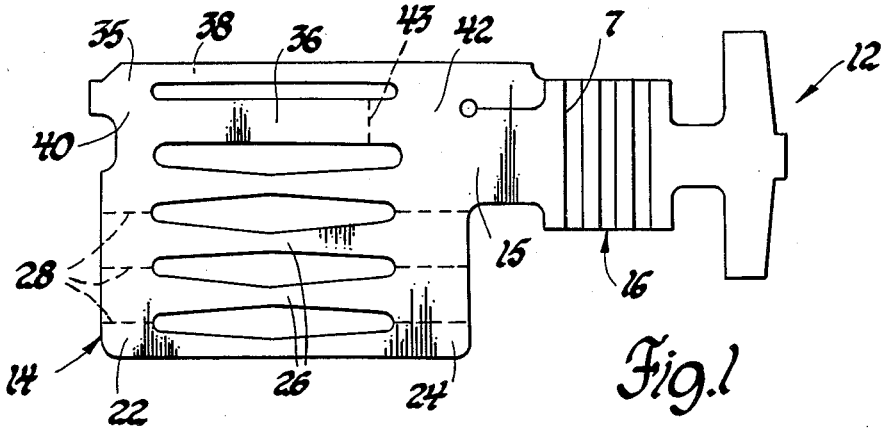
FIG. 1 is a plan view of a sheet metal blank for forming an electric socket terminal in accordance with the invention.
Figure 2:
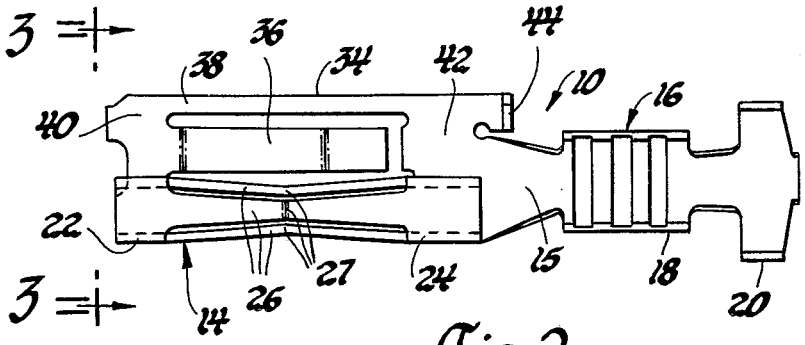
FIG.2 is a side view of the electric socket terminal formed from the blank shown in FIG. 1.
Figure 3:
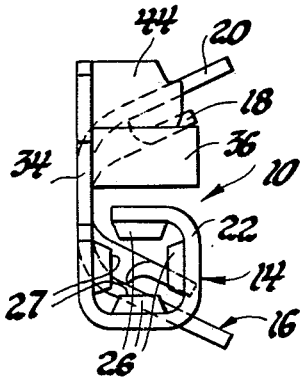
FIG. 3 is a front view of the electric socket terminal shown in FIG. 2.
Figure 4:
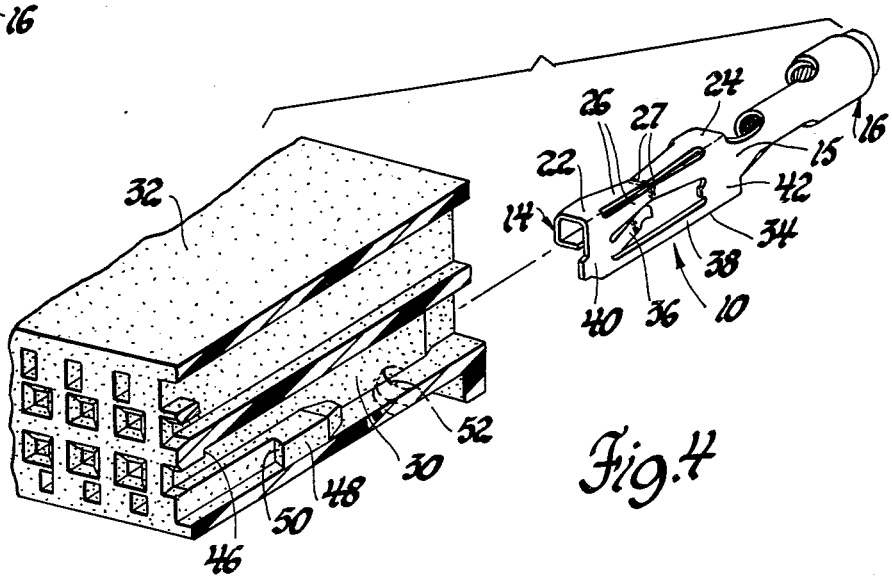
FIG. 4 is an exploded perspective view showing the electric socket terminal and an insulator block having a cavity for receiving the electric socket terminal.

Referring now to the drawing, FIGS. 2, 3 and 4 illustrate an electric socket 10 which is formed by bending the sheet metal blank 12 shown in FIG. 1.

The terminal 10 has an elongated, resilient socket 14 at one end and a conductor attachment 16 at the other end, comprising more or less conventional conductor core and insulation crimp barrels 18 and 20.

The socket 14 comprises a pair of axially spaced, split tubes 22 and 24 which are joined by a circumferential array of juxtaposed spring strips 26.

The split tubes 22 and 24 are rectangular and formed by bending the blank 12 at the three dashed bend lines 28 shown in FIG. 1.

The circumferential array of juxtaposed spring strips 26 consist of four spring strips 26 which are integral at each end with the respective sides of the split rectangular tubes 22, 24. The spring strips 26 taper inwardly from each end in plan form as shown in FIG. 1 and are bent inwardly as shown in FIGS. 2, 3 and 4 to provide four contacts 27 at their narrowest width for biasingly engaging a round or rectangular pin terminal (not shown) inserted into the resilient socket 14.

The electric socket terminal 10 further includes means for retaining the electric socket terminal 10 in a cavity 30 of an insulator block 32 such as shown in FIG. 4. The retaining means 34 is formed from a web 35 beside the elongated, resilient socket 14 and comprises a resilient latch tang 36 which is cut out or struck from the web 35 as shown in FIG. 1, leaving a U-shaped guard 38 to protect the resilient latch tang 36 as shown in FIGS. 2 through 4.

The resulting U-shaped guard 38 has axially spaced legs 40,42 which are integrally attached to the respective split tubes 22,24 and it should be noted that the resilient latch tang 36 is nearly as long as the spring strips 26. The U-shaped guard 38 is preferably coplanar with a corresponding pair of the sides of the split rectangular tubes 23,24 to eliminate a bending operation during formation of the electric socket terminal 12. This coplanar arrangement also provides for a strong transition 15 between the resilient socket 14 and the conductor attachment 16.

The resilient latch tang 36 is integrally attached at the inward edge of the leg 40 at one end and severed from the leg 42 at the other end as indicated by the dotted cut line 43 in FIG. 1.

The resilient latch tang 36 extends generally axially of the resilient socket 14 and it is preferably bent out of the plane of the U-shaped guard 38 in the direction where it overlies the resilient socket 14 as shown in FIG. 3. This arrangement provides additional protection for the resilient latch tang.

The retaining means 34 may also include a perpendicular ear 44 at the rearward end of the leg 42 to provide a positive or secondary lock as explained below.

Referring now to FIG. 4, the terminal 10 is inserted into the cavity 30 until the leading edge of the split, rectangular tube 22 engages an internal stop shoulder 46. During insertion, the resilient latch tang 36 deflects over an internal projection 48 and engages behind another internal shoulder 50 to prevent terminal withdrawal. Thereafter, the insulator block 32 may then be staked to provide a local protrusion 52 in the cavity 30 (shown in phantom) which is behind the ear 44 and serves as a positive or secondary lock which prevents terminal withdrawal and supplements the retention of resilient latch tang 36 and shoulder 50.

While a rectangular socket and an array of four spring strips have been illustrated, other shapes and arrays are possible. In other words, we wish it to be understood that we do not desire to be limited to the exact details of construction shown and described, for obvious modifications will occur to a person skilled in the art.

The embodiments of the invention in which an exclusive property or privilege is claimed are defined as follows:

1. An electric socket terminal comprising:

an elongated, resilient socket having two axially spaced split tubes joined by a circumferential array of juxtaposed spring strips, means beside the elongated, resilient socket for retaining the electric socket terminal in a cavity of an insulator block or the like, said means including a U-shaped guard extending outwardly of the resilient socket and a resilient latch tang, said U-shaped guard having axially spaced legs which are integrally attached to the respective split tubes of the resilient socket, and said resilient latch tang being integrally attached at one end to one of the legs of the U-shaped guard and extending generally axially of the elongated, resilient socket.

2. An electric socket terminal comprising:

an elongated, resilient socket having two axially spaced split tubes joined by a circumferential array of juxtaposed spring strips, means beside the elongated, resilient socket for retaining the electric socket terminal in a cavity of an insulator block or the like, said means including a planar U-shaped guard extending outwardly of the resilient socket and a resilient latch tang, said U-shaped guard having axially spaced legs which are integrally attached to the respective split tubes of the resilient socket, said resilient latch tang being integrally attached at one end to one of the legs of the U-shaped guard and extending generally axially of the elongated, resilient socket, and said resilient latch tang being bent out of the plane of the U-shaped guard in a direction where it overlies the elongated, resilient socket.

3. An electric socket terminal comprising:

an elongated, resilient socket having two axially spaced rectangular split tubes joined by a circumferential array of juxtaposed spring strips, means beside the elongated, resilient socket for retaining the electric socket terminal in a cavity of an insulator block or the like, said means including a U-shaped guard which is a coplanar extension of a corresponding pair of sides of the rectangular split tubes and which extends outwardly of the resilient socket, and a resilient latch tang, said U-shaped guard having axially spaced legs which are integrally attached to the corresponding pair of sides respectively, said resilient latch tang being integrally attached at one end to one of the legs of the U-shaped guard and extending generally axially of the elongated, resilient socket, and said resilient latch tang being bent out of the plane of the U-shaped guard in a direction where it overlies the elongated, resilient socket.

* * * * *

UNITED STATES PATENT AND TRADEMARK OFFICE

CERTIFICATE OF CORRECTION

PATENT NO. : 4,448,477

DATED : May 15, 1984

INVENTOR(S) : Joseph H. Gladd et al

It is certified that error appears in the above—identified patent and that said Letters Patent is hereby corrected as shown below:

Column 1, line 34, after "accommodate the resilient" should read -- latch tang. --.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*